US006419104B1

(12) United States Patent
Sarajian

(10) Patent No.: US 6,419,104 B1
(45) Date of Patent: Jul. 16, 2002

(54) COMPRESSIBLE PLUG WITH INTERNAL COMPRESSION ANCHOR

(75) Inventor: Kissak T. Sarajian, Glendale, CA (US)

(73) Assignee: Engineered Products & Services Inc., Brookfield, WI (US)

( * ) Notice: Subject to any disclaimer, the term of this patent is extended or adjusted under 35 U.S.C. 154(b) by 0 days.

(21) Appl. No.: 09/595,079

(22) Filed: Jun. 16, 2000

(51) Int. Cl.[7] ..... B65D 39/12
(52) U.S. Cl. ..... 220/234; 215/358; 215/361
(58) Field of Search ..... 220/234, 235, 220/236; 215/279, 292, 358–361

(56) References Cited

U.S. PATENT DOCUMENTS

| | | | | |
|---|---|---|---|---|
| 2,315,538 A | | 4/1943 | Moeller | |
| 2,439,628 A | * | 4/1948 | Kopecky | 215/360 |
| 2,506,362 A | | 5/1950 | Hofmann | |
| 2,566,816 A | * | 9/1951 | Work | 220/235 |
| 3,317,071 A | * | 5/1967 | Teeter | 215/360 |
| 3,365,093 A | * | 1/1968 | Malenke | 220/235 |
| 3,489,312 A | * | 1/1970 | Hunckler et al. | 220/235 |
| 3,604,591 A | | 9/1971 | Seltzer | |
| 3,618,809 A | * | 11/1971 | Martino | 220/235 |
| 3,836,035 A | * | 9/1974 | Simbirdi | 220/235 |
| 4,170,247 A | | 10/1979 | Bates | |
| 4,178,966 A | | 12/1979 | Savor et al. | |
| 4,254,801 A | | 3/1981 | Gerthoffer et al. | |
| 4,436,117 A | | 3/1984 | Martin | |
| 4,759,462 A | * | 7/1988 | Neglio | 220/235 |
| 4,765,374 A | | 8/1988 | Ermold et al. | |
| 4,930,657 A | * | 6/1990 | Walker | 220/235 |
| 4,982,763 A | | 1/1991 | Klahn | |
| 5,735,425 A | * | 4/1998 | Beadle | 220/235 |

OTHER PUBLICATIONS

Excerpts from "epsi Buying Guide to Masking and Hanging Products for the Finishing Industry", catalog. espi, 4235 North 127th Street, Brookfield, WI 53005. pp. 1–39.
Date: Document is undated, but plugs shown on pp. 1–39 were commercially available prior to Jun. 6, 1999.
"Shaw Aero Development—The Seal Of Approval For Today's Manufactures", advertising flier. Shaw Aero Development, Naples, Florida.
Date: Document is undated, but plugs shown were commercially available prior to Jun. 6, 1999.

* cited by examiner

*Primary Examiner*—Nathan J. Newhouse
(74) *Attorney, Agent, or Firm*—Jansson, Shupe & Munger, Ltd.

(57) ABSTRACT

The invention disclosed and claimed is an improved plug with an internal anchor. The plug has particular utility in masking openings in parts to be coated. Generally, the plug comprises a compressible, resilient plug body and a compression mechanism. The compression mechanism compresses the plug body between an internal plug anchor and an opposed plug compression surface. The compressive force causes the plug circumference to increase forming a tight seal between the plug and walls forming the opening. The internal anchor design and absence of any axial opening through the entire plug body prevent fluids and other coating materials from passing through the internal plug body and into the interior of the part to be coated thereby avoiding costly damage to the part.

12 Claims, 5 Drawing Sheets

COMPRESSIBLE PLUG WITH INTERNAL COMPRESSION ANCHOR

FIELD OF THE INVENTION

This invention is related generally to improved plug apparatus and, more specifically, to plug apparatus providing improved resistance to liquid and material flow.

BACKGROUND OF THE INVENTION

Many types of manufactured parts, such as parts used in the manufacture of automobiles and machinery, must be coated with various materials and substances to adapt those parts for their intended end use. The coatings impart desired characteristics to the parts, such as resistance to corrosion or friction. Many different types of materials can be applied to the parts including nylons, polycarbonates, metals, etc. Among the well-known types of coating operations used to apply various substances to parts include coating by powder coating, anodizing and plating.

In all of these coating operations, the surface portions of the part are completely exposed to the coating substance. In powder coating operations the part to be coated is typically electrostatically charged and heated and then exposed to a fine particulate spray or fluidized bed of oppositely-charged coating particles. The particles are attracted to the surface to be coated and are melted, forming a coating over the part. In anodizing and plating operations, the part to be coated is charged and then dipped into a bath containing the coating material. The coating material is attracted to the part and is deposited onto the exposed surface portions of the part.

Many types of parts to be coated include internal surface portions which must not be coated. These types of parts are typically three-dimensional, include outer and inner surface portions and include various openings (also known as holes) in the part outer surface through which coating materials could enter the part and undesirably come into contact with the internal surface portions of the part.

It may be undesirable to apply a coating to the internal surface portions of these types of parts for many reasons. For example, it may be undesirable to apply a coating to the internal surface portions of a valve or pipe because that coating may be incompatible with fluids or gases to be conveyed through the valve or pipe. Also by way of example, it may be undesirable to apply a coating to threads cut in the internal surface portion of an annular opening in a tube or other part because that coating may interfere with operation of the threads. It may be undesirable for the liquid media used in plating or anodizing operations to come into contact with the internal surface portions of a part because the media can damage the internal surface portions of the part.

Various products have been developed to mask, or close, the openings in these parts thereby preventing coating materials from coming into contact with the internal surface portions of the parts. For example, a variety of caps and plugs are commercially available to mask openings in the part to be coated. These masking devices are configured for the particular application. For example, plugs are intended to be inserted into the opening. The plug has a tapered outer body at least a portion of which has an outside diameter which is larger than the inside diameter of the opening. The plug is held in place by the frictional fit between the plug outer body and the walls forming the opening in the part.

Conventional plugs are available in many sizes and shapes and include configurations ranging from gently tapered annular plug bodies to plug bodies having pronounced conical designs. Conventional plugs are available in many types of materials including, for example, cork, silicone and EPDM rubber.

Conventional plugs are quite suitable for use in masking most openings in parts and for use with most coating operations. However, these types of masking devices may provide a less-than-complete seal under certain circumstances. For example, certain types of parts may include a confined void volume formed by internal walls of the part and the plug inserted into the opening in the part. If the part is to be heated as part of the coating operation, gas inside the part void volume can expand, potentially forcing the plug partially or completely out of the opening. Failure of the plug may undesirably expose the internal surface portions of the part to the coating material.

By way of further example, conventional plugs may form a less-than-complete seal around a threaded opening in the part, particularly where the threads are cut deeply into the walls forming the opening. A less-than-complete seal in such a threaded opening may permit coating materials, such as the liquid media used in plating and anodizing operations, to enter into the interior surface portions of the part by flowing along the threads.

Other types of commercially-available plugs for masking openings in parts include apparatus to more completely engage the plug body with the opening walls. These conventional devices include a plug body made of a compressible material and a lever arm with a camming apparatus or other compressing apparatus. The compressing apparatus applies force to the plug body thereby compressing the plug body and expanding the plug circumferentially forming a tight fit between the plug and the opening walls.

Compressible plugs are advantageous because they are less likely to be dislodged from an opening by the expanding gas forces within a heated part. In addition, the tight seal formed between the compressible plug and the part can form a more complete seal between the plug body and a threaded opening, particularly where the plug body is made of a soft material which can conform to the threads.

However, conventional compressible plugs may not be suitable for use in all coating applications, particularly those applications in which the part is immersed in a liquid media. It has been found that liquid media (such as used in anodizing and plating operations) can flow through an axial opening provided in the plug body and into interior portions of the part. The axial opening is coextensive with the plug body and is provided so that a rod may be inserted through the plug body to join opposed external plates between which the plug body is compressed.

Passage of even a small amount of liquid media between the external plates, through the plug body and against the interior surface portions of the part can severely damage the part. The damage may be so extensive that the part must be discarded or the part may require repair and remediation at undue cost. As can be understood, damage of parts is a particular problem in large scale coating operations, such as those found in the automotive industry. Loss of, or damage to, even a small percentage of the parts to be coated can result in significant monetary loss to the manufacturer.

It would be significant improvement in the art to provide a plug for masking one or more openings in a part to be coated which would form a complete seal between the plug and opening walls of the part to be coated, which would prevent passage of liquids and other coating materials through the internal plug body, which would be simple and easy to use and which would be reusable.

OBJECTS OF THE INVENTION

It is an object of this invention to provide an improved plug apparatus which overcomes problems and shortcomings of the prior art.

Another object of this invention is to provide an improved plug apparatus which completely seals an opening in a part, particularly to prevent liquids and other materials from entering the opening.

A further object of this invention is to provide an improved plug apparatus which completely seals an opening in a part and which prevents passage of liquids and other materials into the part through the internal plug body.

Yet another object is to provide an improved plug apparatus which is simple and easy to use.

Still another object of this invention is to provide an improved plug apparatus which forms a tight seal across an opening in a part.

An additional object is to provide an improved plug apparatus which is reusable.

How these and other objects are accomplished will be apparent from the descriptions of this invention which follow.

SUMMARY OF THE INVENTION

Figure 1:
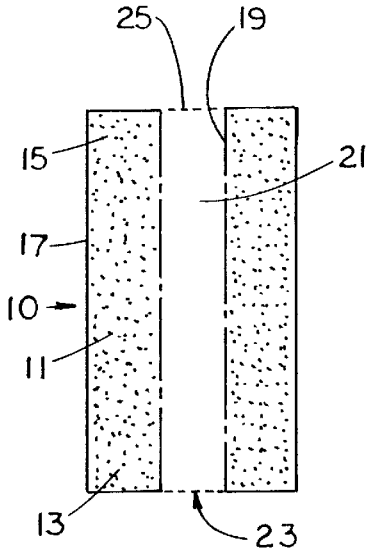
FIG. 1 PRIOR ART
FIG. 1 is a cross-sectional view of an exemplary prior art plug body taken approximately in the mid-section of the body.

The present invention is an improved reusable plug apparatus. The plug has particular utility in coating operations and for masking openings in a part to be coated. The invention includes novel structure preventing liquids and other coating materials applied to the part from passing through the internal plug body and into contact with the interior of the part to be coated thereby avoiding costly damage to the part.

Preferred forms of the plug include a reusable plug body having first and second ends, an internal anchor disposed entirely within the plug body and a rod loosely positioned in the plug body. The rod is attached at a first end to the anchor and at a second end to a compression mechanism. The preferred compression mechanism moves the rod and internal anchor toward the plug second end thereby applying compressive force to the plug and expanding the plug circumferentially so that the plug may be secured across an opening in a part to be coated.

The preferred plug body is reusable and is made of a compressible, resilient material such as silicone, neoprene, EPDM rubber or any elastomeric material with appropriate properties (such as resistance to heat or corrosive effects of certain liquid media). The plug body may be of any suitable size and configuration needed to appropriately mask the part opening and may include unitary as well as multi-part designs. The preferred plug body has first and second ends and an axial internal opening. The internal opening extends partially through the plug body and has one end coextensive with the plug second end and another end extending to a terminus within the plug body.

It is most preferred that the plug body include a compression surface along the plug second end for engaging the compression mechanism. Preferably, a plate such as a nylon or metal washer, is positioned across at least a portion of the compression surface for engaging the compression mechanism thereby providing a wear surface for the plug compression surface and extending the service life of the plug.

The internal anchor is embedded in the plug body and is preferably spaced from the plug first end. The internal anchor is in communication with the opening terminus and may include a threaded internal anchor neck portion configured to mate with the rod first end. The anchor may comprise the opening terminus. The internal anchor may be of any suitable configuration capable of engaging the plug body material and may, for example, include a flange and/or other attachment structure such as a shoulder.

The preferred rod is positioned loosely through the plug body axial opening. The rod includes a first end attached to the internal anchor. Preferably the rod first end is threaded and is mated with the threaded neck portion of the internal anchor. The rod second end is coupled to the compression mechanism. The rod is provided as a link between the anchor and the compression mechanism and is not limited to any particular material or configuration.

The preferred compression mechanism is, as described above, attached to the rod second end. The compression mechanism has at least one position in which the compression mechanism moves the internal anchor toward the plug second end thereby applying compressive force to the plug and expanding the plug circumferentially so that the plug may be secured across the opening. The compression mechanism also has at least a second position in which the compressive force applied to the plug is released so that the plug may be easily removed from the part opening.

The most highly preferred form of compression mechanism comprises a lever pivotally mounted on the rod second end, a camming surface on the lever for engaging the plug second end directly along the plug compression surface or along a plate positioned over said surface. In a first position, the lever camming surface applies compressive force to the plug between the anchor and plate and in a second position the compressive force applied by the lever camring surface is released.

Other types of compression mechanisms may be used. For example, the compression mechanism may comprise a threaded portion along the rod second end and a threaded fastener, such as a nut, configured to engage the rod second end threaded portion. As the fastener is tightened, it engages the plug second end along the plug compression surface and preferred plate. In at least a first position, the fastener applies compressive force to the plug and in at least a second position the compressive force applied by the fastener is released.

The advantageous design of the inventive reusable plug provides a tight, secure seal between the outer surface of the plug and the opening of a part to be masked and at the same time prevents fluid migration through the plug body as is the case with prior art designs. Any fluid or other material which might enter the plug body of the inventive plug is blocked from further movement by the opening terminus and anchor. By preventing liquids and other materials from entering the internal portions of the parts being coated it is expected that the inventive plug will result in fewer damaged parts and will result in significant cost savings.

Further aspects and advantages of the invention will become apparent to those skilled in the art from a review of the following detailed description taken in conjunction with the drawings and the appended claims. It should be noted that the invention is susceptible to embodiments in various forms. Therefore, the specific embodiments described hereinafter are provided with the understanding that the present disclosure is intended as illustrative and is not intended to limit the invention to the specific embodiments described herein.

DETAILED DESCRIPTION

Figure 2:
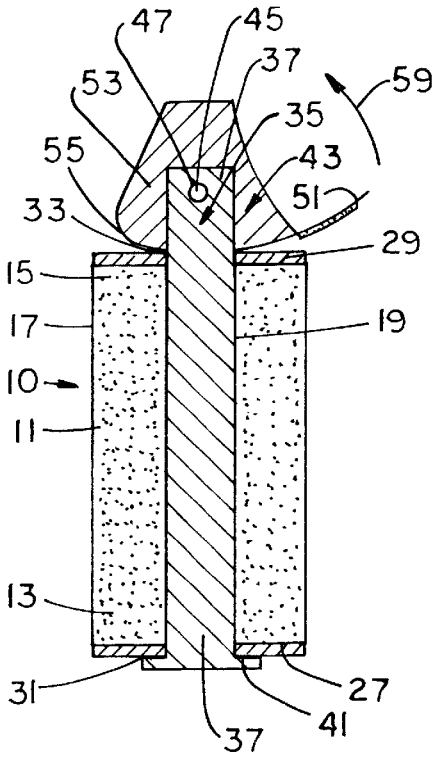
FIG. 2 PRIOR ART
FIG. 2 is a cross-sectional view of an exemplary prior art plug taken approximately in the mid-section of the plug.

FIGS. 1–2 show a prior art plug 10. Prior art plug 10 includes plug body 11 made of an elastomeric material. Plug 10 is intended to be inserted into an opening (not shown) in a part (not shown) in order to prevent liquids, coating materials and other substances from entering the opening and coming into contact with the inner surface portions of the part. As shown best in FIG. 1, plug body 11 includes first end 13, second end 15 and outer surface 17. Internal opening walls 19 form an axial opening 21 coextensive with plug body 11. Opening 21 has a first opening 23 along plug first end 13 and a second opening 25 along plug body second end 15. Axial opening 21 provided in prior art plug 10 extends along the entire length of plug body 11 disadvantageously providing a passageway through which fluids, gasses and particulates can migrate along opening 21, through plug 10 and into the inner surface portions of the part.

As shown in FIG. 2, prior art plug 10 includes bottom plate 27 which is positioned against plug body first end 13 and top plate 29 positioned against plug body second end 15. Plates 27 and 29 are typically washers. Annular opening 31 is formed in bottom plate 27 and annular opening 33 is formed in top plate 29.

Also as shown in FIG. 2, rod 35 is positioned loosely through axial opening 21. Accordingly, rod 35 is moveable within axial opening 21. Rod 35 includes rod first end 37 and rod second end 39. Rod first end 37 extends through annular opening 31 in bottom plate 27 while rod second end 37 extends through annular opening 33 in top plate 29. An appropriate fastener, such as nut 41, is secured to rod first end 37 along threads (not shown).

Cam lever 43 is moveably secured to rod second end 39 by pivot pin 45. Pivot pin 45 is inserted through hole 47 in rod second end 39 and through holes 49*a* and 49*b* (not shown) provided in cam lever 43. Cam lever 45 includes handle 51, cam lever body 53 and cam surface 55. Movement of cam lever 43 in the direction of arrow 59 urges cam surface 55 against compression surface 57 provided on plate 29. Nut 43 is moved against bottom plate 27 causing bottom plate 27 to move toward top plate 29 as rod 35 is moved by the action of the cam lever 43. Compressive force applied through plates 25 and 27 expands the plug body 11 circumferentially forming a seal between the plug outer surface 17 and the interior walls (not shown) of a part. The prior art plug 10 does not close the passageway formed by axial opening 21 and does not solve the problem of preventing infiltration of liquids and other materials through plug 10 and into the interior portions of the part.

Figure 3:
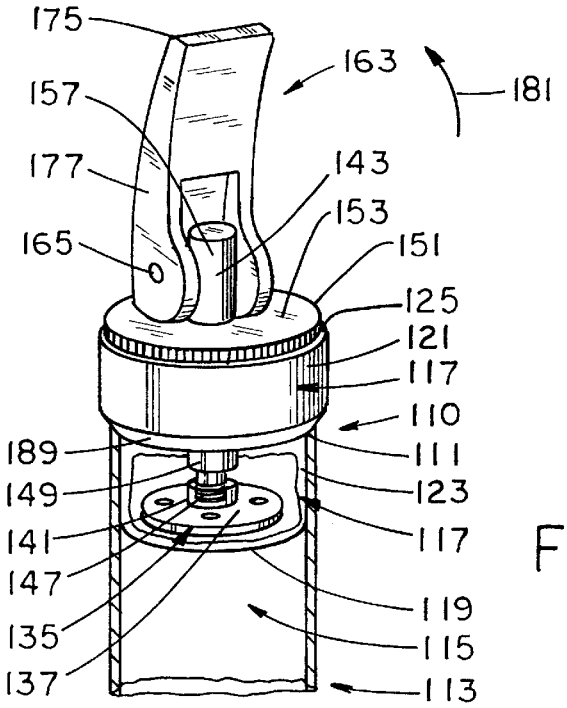
FIG. 3 is a partial perspective drawing of an exemplary plug of the invention positioned in an opening in a part including a partial cut-out showing internal plug components.
Figure 4:
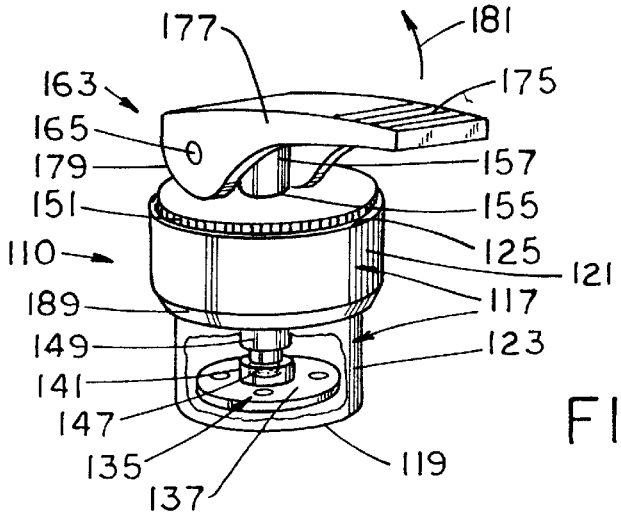
FIG. 4 is a partial perspective view of an exemplary plug of the invention including a partial cut-out showing internal plug components.
Figure 5:
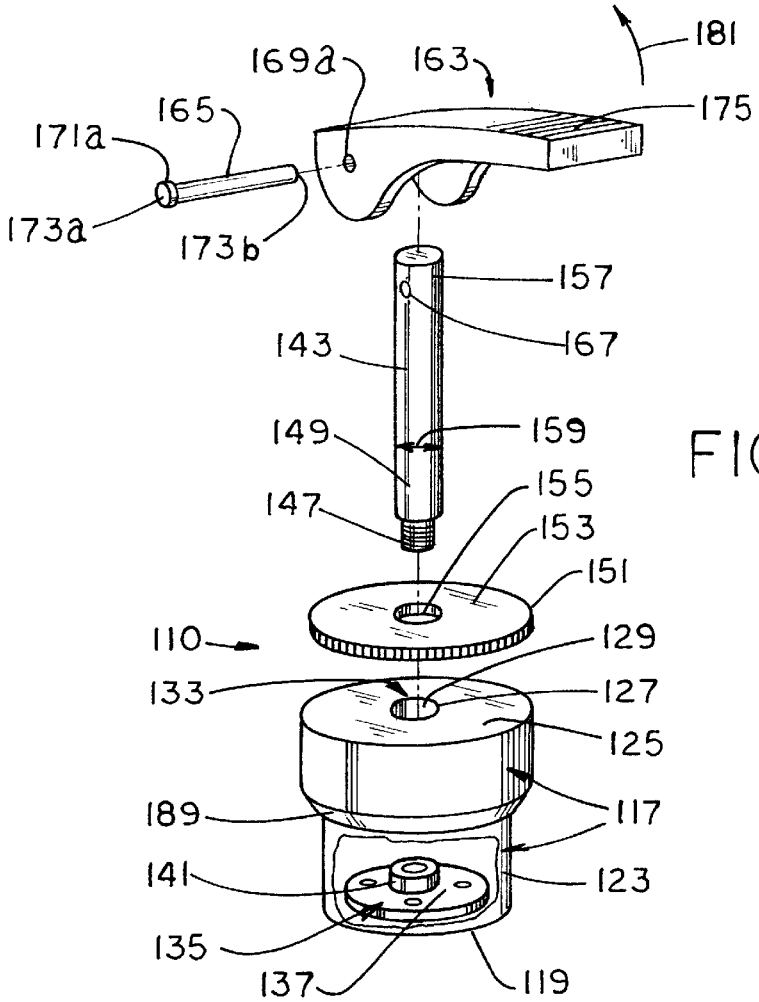
FIG. 5 is an assembly view of an exemplary plug of the invention including a partial cut-out showing internal plug components.
Figure 6:
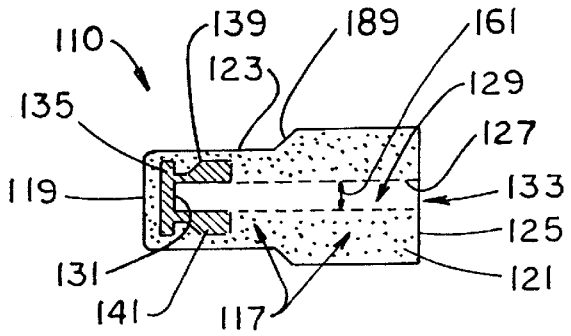
FIG. 6 is a cross-sectional view of an exemplary plug body of the invention including an anchor.
Figure 7:
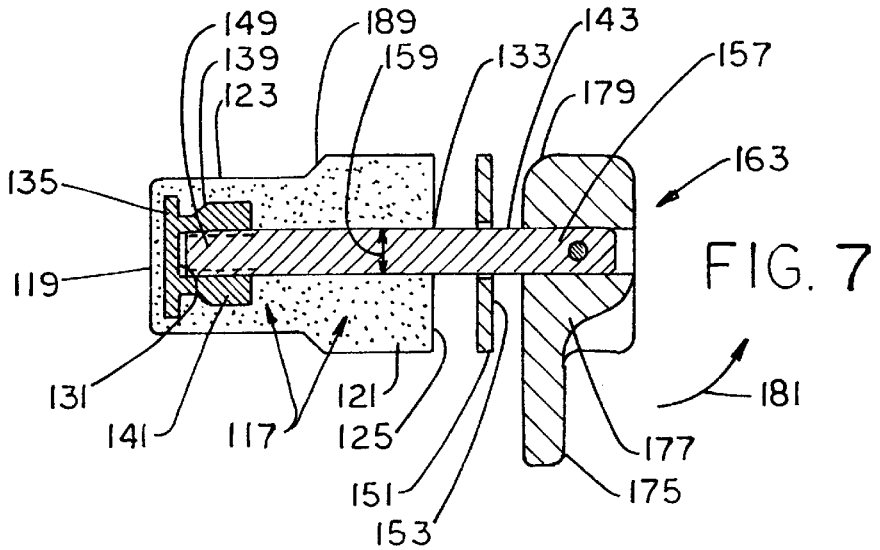
FIG. 7 is a cross-sectional view of an exemplary plug of the invention. taken along section 7—7 of FIG. 8.
Figure 8:
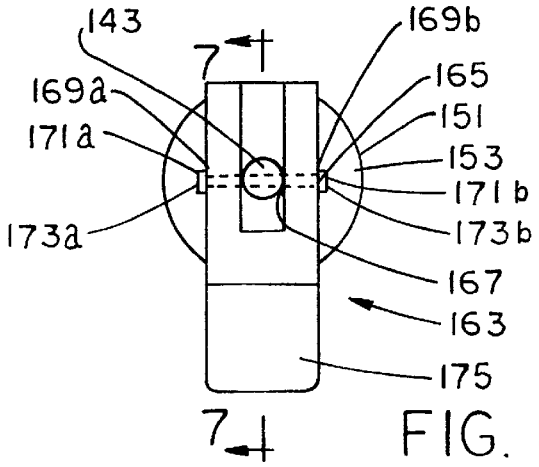
FIG. 8 is a top perspective view of an exemplary plug of the invention.
Figure 9:
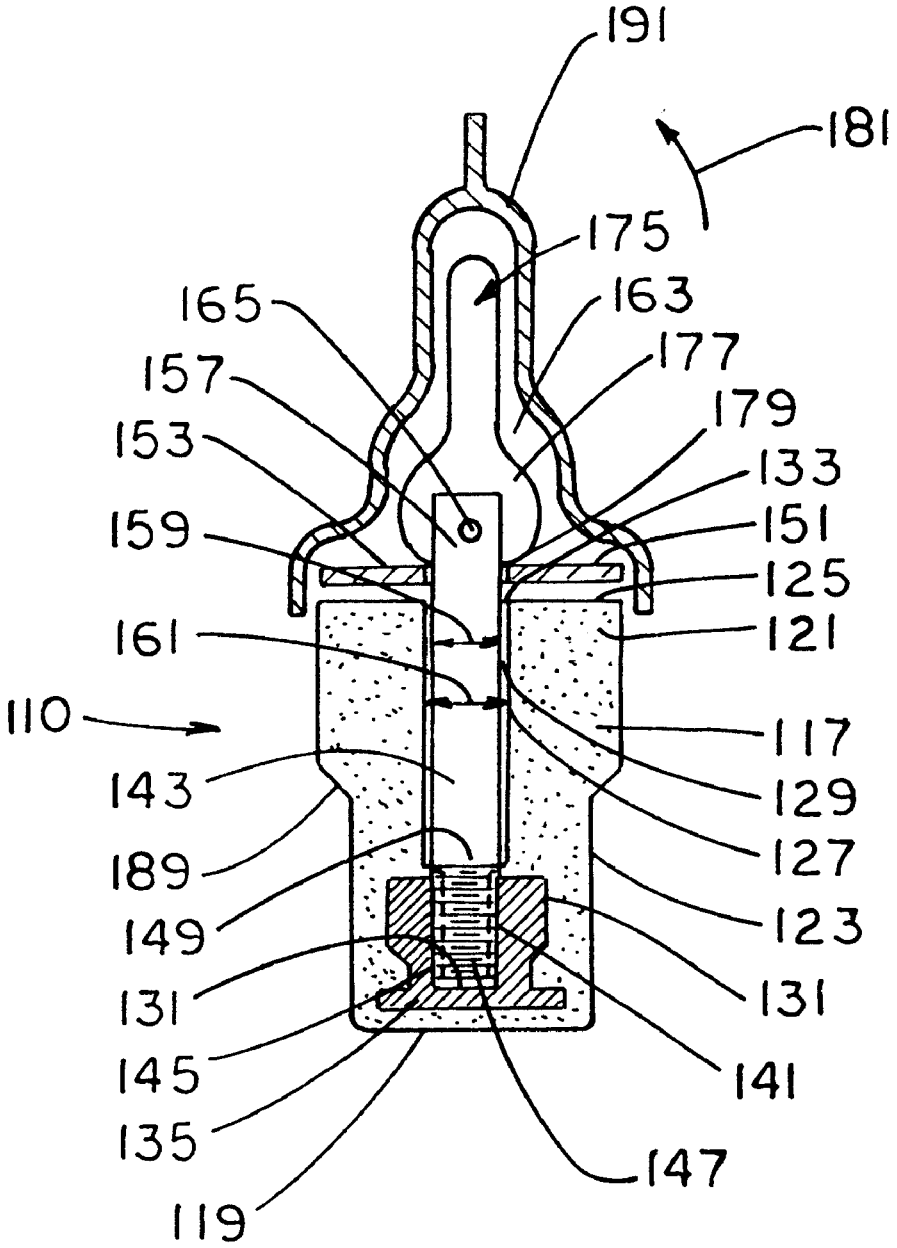
FIG. 9 is a cross-sectional view of an exemplary plug body of the invention including an optional protective cap.

FIGS. 3–10 show alternative exemplary embodiments of the invention and demonstrate how the abovementioned disadvantages of the prior art plugs have been overcome. FIG. 3 shows the inventive plug 110 inserted into an opening in part 113 formed by at least one wall 111. Plug 110 is provided in part 113 to mask the opening formed by wall 111 prior to coating of part 113 in a coating operation. Plug 110 is provided to prevent liquids or other coating materials from entering opening and coating, or coming into contact, with part inner surface 115. Part 113 shown in FIG. 4 is in the form of a tubular pipe. However, plug 110 may be used with any shape part provided that plug 110 is of an appropriate configuration to mask an opening formed by wall or walls 111. Plug 110 is selected to be of a size slightly smaller than that of the opening formed by wall 111 so that plug 110 can be easily placed into the opening and then held tightly in the opening once the plug 110 circumference is expanded by the compressive forces applied to the plug 110.

Plug 110 shown in FIGS. 3–10 includes plug body 117 made of a suitable elastomeric material, such as silicone, neoprene, EPDM rubber. Plug body 117 includes first end 119, second end 121 and outer surface 123. Plug body second end 121 includes a compression surface 125 which is acted against by the compression. mechanism as described below. Internal opening walls 127 form an axial opening 129 partially coextensive with plug body 117. Opening 129 includes a terminus 131 within plug body 117 spaced apart from plug body first end 119 and an opening 133 along plug second end 121. The axial opening 129 provided in plug 110, therefore, does not extend along the entire length of plug body 117. Terminus 131, in effect, forms a wall preventing migration of materials through opening 129. Fluids, gasses and particulates cannot pass through opening 129 and into part inner surface 115 as is the case with prior art plugs.

As is further shown in FIGS. 3–10, plug 110 includes internal anchor 135 spaced apart from plug body first end 119. Anchor 135 shown in FIGS. 3–10 is positioned entirely within plug body 117 by any suitable means. For example, in plugs having a plug body 117 made of a rubber material, anchor 135 may be positioned in plug body 117 prior to vulcanization of the rubber material forming plug body 117. Anchor 135 may be made of any suitable material such as nylon 6—6, teflon, stainless steel or other metal.

As is apparent from FIGS. 3–7 and 9–10, anchor 135 may be provided in any suitable configuration capable of forming a secure fit within plug body 117. For instance, anchor 135 may include flange 137 (FIGS. 3–7, 9–10) and/or shoulder 139 (FIGS. 6–7) formed around anchor 135 to better secure anchor 135 within plug body 117.

Neck 141 may be provided be provided in anchor 135 to mate with rod 143. Neck 141 may include threads 145 for mating with corresponding threads 147 along rod first end 149. Any suitable manner of connecting anchor 135 to rod 143 may be used.

Plate 151 is shown positioned against plug body second end 121. Plate 151 is optionally provided to serve as a wear surface across compression surface 125 formed by plug body second end 121. When a plate 151 is used, plate compression surface 153 serves as a surface against which the compression mechanism acts as described below. Plate 151 is typically a washer. Plate 151 may be made of any suitable material such as nylon 6—6, teflon, stainless steel or any other suitable metal. Opening 155, which may be annular in shape, is formed in plate 151 through which rod 143 is positioned.

Rod 141 includes rod first end 149 and rod second end 157. Rod first end 149 mates with anchor 135. Rod second end 157 extends away from plug body 117 through opening 155 of plate 151. As shown best in FIG. 7, rod 143 is positioned through axial opening 129. Rod 141 has an outside diameter 159 which is less than the inside diameter 161 of axial opening 129. Accordingly, rod 143 is moveable within axial opening 129.

FIGS. 3–10 show embodiments of preferred compression mechanisms (i.e., compression means) used to apply compressive force to the plug 110 and to expand the plug 110 circumferentially so that at least a portion of plug outer surface 123 will firmly engage walls 111 in part 113 masking the opening and preventing plug 110 from becoming dislodged from part 113 during use. The secure fit provided by the compression mechanism also permits plug 110 to resist movement caused by force applied from expanding gases within part 113. The compression mechanism is not limited to any particular embodiment as will be described below.

The compression mechanism includes cam lever 163 moveably secured to rod second end 157 by pivot pin 165. Pivot pin 165 is inserted through hole 167 along rod second end 157 and through holes 169*a* and *b* provided in cam lever 163. Pin 165 may be held in place by an appropriate means such as by forming flanges 171*a* and *b* in pivot pin ends 173*a* and *b*. These compression mechanism components may be made of any suitable material including those listed above with respect to the anchor 135 and rod 143 components.

Cam lever 163 includes handle 175, cam lever body 177 and cam surface 179. When cam lever 163 is moved in the direction of arrow 181 to the first, or compression, position shown in FIG. 3, cam surface 179 is urged against compression surface 153 on plate 151. In the first position, compressive force applied through anchor 135 and plate 151 expands plug body 117 circumferentially forming a tight seal between the plug outer surface 123 and the interior walls 111 of part 113. When cam lever 157 is moved in a direction opposite to arrow 181, to a second, or release, position as shown in FIG. 4, compressive force is released permitting plug 110 to be easily removed from opening 111. As is apparent, cam lever 163 can be quickly moved between the first and second positions permitting rapid insertion and removal of plug 110 into and from part 113.

Figure 10:
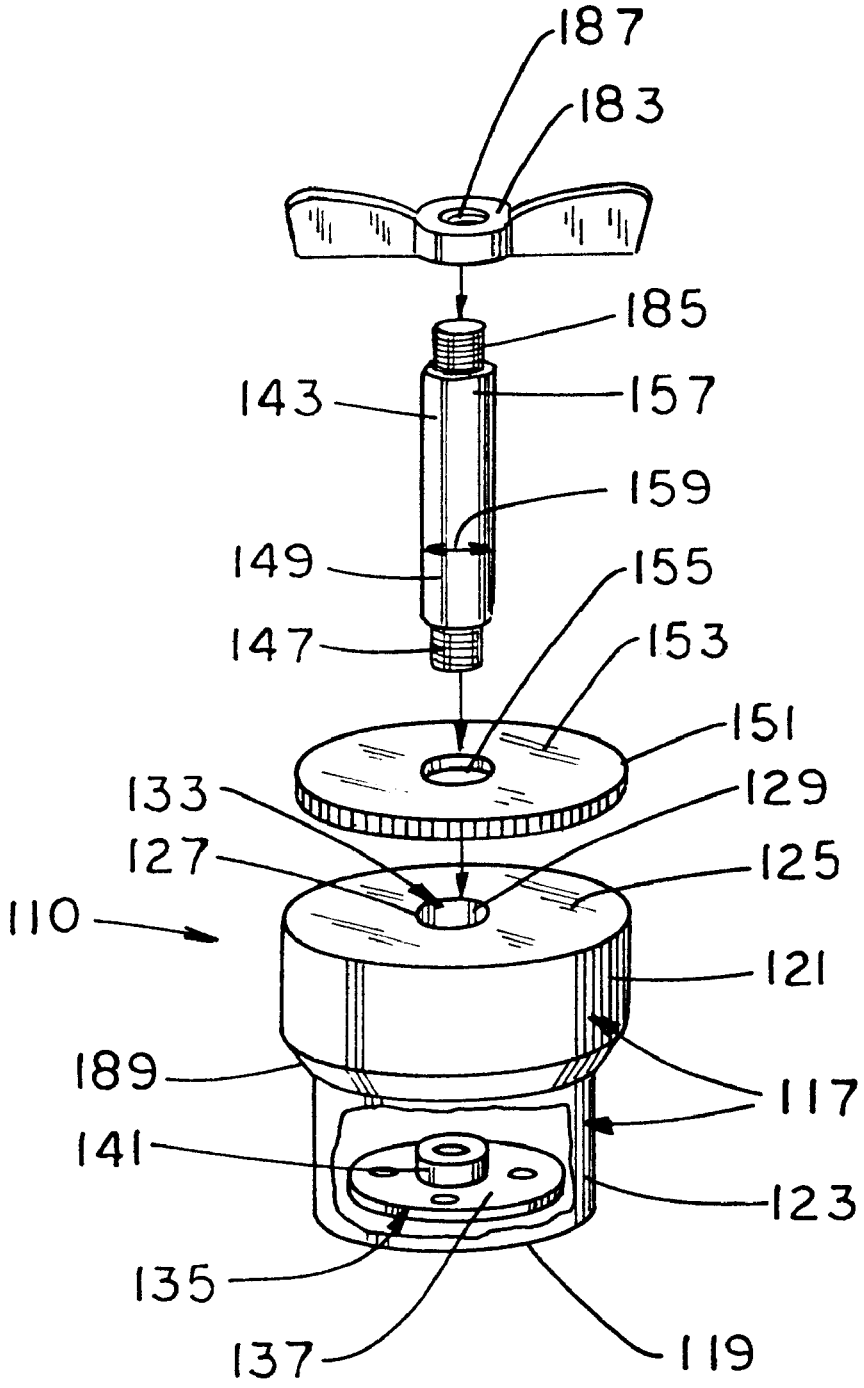
FIG. 10 is an assembly view of an exemplary plug of the invention including a partial cut-out showing internal plug components.

Other types of compression mechanisms may be used. As shown in FIG. 10, urging means in the form of a nut 183 (such as a wing nut) could be used in place of cam lever 157. In such an embodiment, rod second end 157 is provided with a threaded portion 185 for mating with threads 187 of nut 183. Nut 183 is configured to engage rod second end threaded portion 185 and to engage plug second end 121 along compression surface 125 directly or through plate compression surface 153. As nut 183 is tightened (i.e., rotated in a clockwise direction) to a first, or compression, position, the nut 183 gradually urges anchor 135 toward plate 151 applying compressive force to plug 110 to firmly secure plug 110 in opening 111. As nut 183 is loosened (i.e., rotated in a counterclockwise direction) to a second, or release, position, the compressive force is gradually released until plug 110 may be easily removed from opening 111. This arrangement also permits quick movement between the first and second positions thereby permitting rapid insertion and removal of plug 110 into and from part 113.

Other optional configurations and components may be provided in, or used in conjunction with, the invention so as to customize plug 110 for use in a particular operation. For example, plug body 117 may include a shoulder, such as annular shoulder 189 (FIGS. 3–10) provided to abut part 113. Shoulder 189 is provided to form a more complete mask over the opening formed by walls 111 during a coating operation. Annular ribs (not shown) could be provided around outer surface 123 of an annular plug to provide for a better frictional fit between plug 110 and an annular opening in a part 113. The plug body 117 could consist of two body portions (not shown) separated by a spacer. A cap 191 (FIG. 9) fitted over compression mechanism may be provided to cover the compression mechanism and to protect the compression mechanism from liquids and other materials. Other compression mechanisms, such as those using other types of camming mechanisms, may be utilized as deemed appropriate.

While the principles of this invention have been described in connection with specific embodiments, it should be understood clearly that these descriptions are made only by way of example and are not intended to limit the scope of the invention.

What is claimed is:

1. A plug for masking an opening formed by at least one wall in a part to be coated comprising:

a reusable plug body made of a compressible, resilient material, the plug body having first and second ends, walls defining an axial internal opening having a diameter, said opening being coextensive with the plug second end and extending partially through the plug body to a terminus within the plug body;

an internal anchor disposed entirely within the plug body, the anchor being spaced from the plug first end and in communication with the opening terminus, said anchor including a threaded neck portion;

a rod positioned through the opening, the rod having a diameter less than the opening diameter with said rod sized such that the rod abuts the opening and is movable within the opening, said rod further having a threaded first end configured to mate with the anchor neck portion such that the rod first end is attached to the internal anchor by engagement of the threads and a second end to which a compression mechanism is attached; and a compression mechanism attached to the rod second end, the compression mechanism having a first position in which the internal anchor is moved toward the plug second end thereby applying compressive force to the plug and expanding the plug circumferentially so that the plug may be secured across the opening and a second position in which the compressive force is released so that the plug may be easily removed from the opening.

2. A molded, pressed, fresh cheese composition comprising milk, food grade acid and isolated soy protein, wherein said isolated soy protein has a pH of from about 3 to about 7.

3. The molded, pressed, fresh cheese composition of claim 2, wherein said isolated soy protein is present in the amounts of from about 10% to about 100%.

4. The molded, pressed, fresh cheese composition of claim 2, wherein said milk is present in the amounts of from about 80% to about 100%.

5. The molded, pressed, fresh cheese composition of claim 2, wherein said milk comprises 0% to 5% fat.

6. The molded, pressed, fresh cheese composition of claim 2, wherein said fat is selected from the group consisting of milkfat and vegetable oil.

7. The molded, pressed, fresh cheese composition of claim 2, wherein said acid is present in the amounts of from about 0.05% to about 5%.

8. The molded, pressed, fresh cheese composition of claim 2, further comprising salt.

9. The plug of claim 7, further including;

a plug compression surface along the plug second end for engaging the compression mechanism; and a plate providing a wear surface across at least a portion of the compression surface for engaging the compression mechanism.

10. The plug of claim 7 wherein the internal anchor includes a flange.

11. The plug of claim 7 wherein the compression mechanism comprises:

a lever pivotally mounted on the rod second end;

a camming surface on the lever for engaging the plug second end along a plug compression surface; and in the first position, the lever surface applies compressive force to the plug and in the second position the compressive force applied by the lever camming surface is released.

12. The plug of claim 7 wherein the compression mechanism comprises:

a threaded portion along the rod second end;

a threaded fastener configured to engage the rod second end threaded portion, the fastener provided for applying force along a plug compression surface; and in the first position, the compressive force is applied to the plug and in the second position the compressive force is released.

* * * * *

UNITED STATES PATENT AND TRADEMARK OFFICE

CERTIFICATE OF CORRECTION

PATENT NO. : 6,419,104 B1
DATED : July 16, 2002
INVENTOR(S) : Kissak T. Sarajian It is certified that error appears in the above-identified patent and that said Letters Patent is hereby corrected as shown below:

Delete columns 7-10 and substitute therefor columns 7-10, as shown on the attached pages.

Signed and Sealed this

Eleventh Day of October, 2005

JON W. DUDAS
*Director of the United States Patent and Trademark Office* surface across compression surface 125 formed by plug body second end 121. When a plate 151 is used, plate compression surface 153 serves as a surface against which the compression mechanism acts as described below. Plate 151 is typically a washer. Plate 151 may be made of any suitable material such as nylon 6—6, teflon, stainless steel or any other suitable metal. Opening 155, which may be annular in shape, is formed in plate 151 through which rod 143 is positioned.

Rod 141 includes rod first end 149 and rod second end 157. Rod first end 149 mates with anchor 135. Rod second end 157 extends away from plug body 117 through opening 155 of plate 151. As shown best in FIG. 7, rod 143 is positioned through axial opening 129. Rod 141 has an outside diameter 159 which is less than the inside diameter 161 of axial opening 129. Accordingly, rod 143 is moveable within axial opening 129.

FIGS. 3–10 show embodiments of preferred compression mechanisms (i.e., compression means) used to apply compressive force to the plug 110 and to expand the plug 110 circumferentially so that at least a portion of plug outer surface 123 will firmly engage walls 111 in part 113 masking the opening and preventing plug 110 from becoming dislodged from part 113 during use. The secure fit provided by the compression mechanism also permits plug 110 to resist movement caused by force applied from expanding gases within part 113. The compression mechanism is not limited to any particular embodiment as will be described below.

The compression mechanism includes cam lever 163 moveably secured to rod second end 157 by pivot pin 165. Pivot pin 165 is inserted through hole 167 along rod second end 157 and through holes 169*a* and *b* provided in cam lever 163. Pin 165 may be held in place by an appropriate means such as by forming flanges 171*a* and *b* in pivot pin ends 173*a* and *b*. These compression mechanism components may be made of any suitable material including those listed above with respect to the anchor 135 and rod 143 components.

Cam lever 163 includes handle 175, cam lever body 177 and cam surface 179. When cam lever 163 is moved in the direction of arrow 181 to the first, or compression, position shown in FIG. 3, cam surface 179 is urged against compression surface 153 on plate 151. In the first position, compressive force applied through anchor 135 and plate 151 expands plug body 117 circumferentially forming a tight seal between the plug outer surface 123 and the interior walls 111 of part 113. When cam lever 157 is moved in a direction opposite to arrow 181, to a second, or release, position as shown in FIG. 4, compressive force is released permitting plug 110 to be easily removed from opening 111. As is apparent, cam lever 163 can be quickly moved between the first and second positions permitting rapid insertion and removal of plug 110 into and from part 113.

Other types of compression mechanisms may be used. As shown in FIG. 10, urging means in the form of a nut 183 (such as a wing nut) could be used in place of cam lever 157. In such an embodiment, rod second end 157 is provided with a threaded portion 185 for mating with threads 187 of nut 183. Nut 183 is configured to engage rod second end threaded portion 185 and to engage plug second end 121 along compression surface 125 directly or through plate compression surface 153. As nut 183 is tightened (i.e., rotated in a clockwise direction) to a first, or compression, position, the nut 183 gradually urges anchor 135 toward plate 151 applying compressive force to plug 110 to firmly secure plug 110 in opening 111. As nut 183 is loosened (i.e., rotated in a counterclockwise direction) to a second, or release, position, the compressive force is gradually released until plug 110 may be easily removed from opening 111. This arrangement also permits quick movement between the first and second positions thereby permitting rapid insertion and removal of plug 110 into and from part 113.

Other optional configurations and components may be provided in, or used in conjunction with, the invention so as to customize plug 110 for use in a particular operation. For example, plug body 117 may include a shoulder, such as annular shoulder 189 (FIGS. 3–10) provided to abut part 113. Shoulder 189 is provided to form a more complete mask over the opening formed by walls 111 during a coating operation. Annular ribs (not shown) could be provided around outer surface 123 of an annular plug to provide for a better frictional fit between plug 110 and an annular opening in a part 113. The plug body 117 could consist of two body portions (not shown) separated by a spacer. A cap 191 (FIG. 9) fitted over compression mechanism may be provided to cover the compression mechanism and to protect the compression mechanism from liquids and other materials. Other compression mechanisms, such as those using other types of camming mechanisms, may be utilized as deemed appropriate.

While the principles of this invention have been described in connection with specific embodiments, it should be understood clearly that these descriptions are made only by way of example and are not intended to limit the scope of the invention.

What is claimed:

1. A plug for masking an opening formed by at least one wall in a part to be coated comprising:

a reusable plug body made of a compressible, resilient material, the plug body having first and second ends, walls defining an axial internal opening having a diameter, said opening being coextensive with the plug second end and extending partially through the plug body to a terminus within the plug body;

an internal anchor disposed entirely within the plug body, the anchor being spaced from the plug first end and in communication with the opening terminus, said anchor including a threaded neck portion;

a rod positioned through the opening, the rod having a diameter less than the opening diameter with said rod sized such that the rod abuts the opening and is movable within the opening, said rod further having a threaded first end configured to mate with the anchor neck portion such that the rod first end is attached to the internal anchor by engagement of the threads and a second end to which a compression mechanism is attached; and a compression mechanism attached to the rod second end, the compression mechanism having a first position in which the internal anchor is moved toward the plug second end thereby applying compressive force to the plug and expanding the plug circumferentially so that the plug may be secured across the opening and a second position in which the compressive force is released so that the plug may be easily removed from the opening.

2. The plug of claim 1, wherein the plug body is a unitary member.

3. The plug of claim 1, further including:

a plug compression surface along the plug second end for engaging the compression mechanism; and a plate providing a wear surface across at least a portion of the compression surface for engaging the compression mechanism.

4. The plug of claim 1 wherein the internal anchor includes a flange.

5. The plug of claim 1 wherein the compression mechanism comprises:

a lever pivotally mounted on the rod second end;

a camming surface on the lever for engaging the plug second end along a plug compression surface; and in the first position, the lever camming surface applies compressive force to the plug and in the second position the compressive force applied by the lever camming surface is released.

6. The plug of claim 1 wherein the compression mechanism comprises:

a threaded portion along the rod second end;

a threaded fastener configured to engage the rod second end threaded portion, the fastener provided for applying force along a plug compression surface; and in the first position, the compressive force is applied to the plug and in the second position the compressive force is released.

7. A reusable plug for masking an opening formed by at least one wall in a part to be coated, the plug being adapted to be rapidly inserted into and removed from the opening, the plug having a compressible, resilient body with first and second ends, walls defining an internal axial opening, an anchor spaced from the plug first end in communication with the opening, the anchor including a threaded anchor neck portion, a rod positioned through the opening, the rod having a threaded first end configured to mate with the anchor neck portion such that the rod first end is attached to the internal anchor by engagement of the threads and a second end for supporting a plug-compression mechanism, the compression mechanism having a compression position in which the anchor is moved toward the plug second end thereby compressing the plug body and expanding the body circumferentially to secure the plug with respect to the opening and a release position in which the compressing force is released so that the plug may be rapidly removed from the part, the improvement comprising:

the anchor is disposed entirely within the plug body;

the opening has a diameter and extends partially through the plug body to a terminus within the plug body adjacent to the anchor; and the rod engages the anchor entirely within the plug body, said rod having a diameter less than the opening diameter and being sized such that the rod abuts the opening and is movable within the opening;

whereby, coating material applied to the part cannot migrate through the opening to the part to be coated.

8. The plug of claim 7 wherein the plug body is a unitary member.

9. The plug of claim 7, further including;

a plug compression surface along the plug second end for engaging the compression mechanism; and a plate providing a wear surface across at least a portion of the compression surface for engaging the compression mechanism.

10. The plug of claim 7 wherein the internal anchor includes a flange.

11. The plug of claim 7 wherein the compression mechanism comprises:

a lever pivotally mounted on the rod second end;

a camming surface on the lever for engaging the plug second end along a plug compression surface; and in the first position, the lever camming surface applies compressive force to the plug and in the second position the compressive force applied by the lever camming surface is released.

12. The plug of claim 7 wherein the compression mechanism comprises:

a threaded portion along the rod second end;

a threaded fastener configured to engage the rod second end threaded portion, the fastener provided for applying force along a plug compression surface; and in the first position, the compressive force is applied to the plug and in the second position the compressive force is released.

* * * * *